US005559587A

United States Patent [19]

Ogata et al.

[11] Patent Number: 5,559,587

[45] Date of Patent: Sep. 24, 1996

[54] IMAGE FORMING APPARATUS

[75] Inventors: Takao Ogata, Yokohama; Takeshi Menjo, Tokyo, both of Japan

[73] Assignee: Canon Kabushiki Kaisha, Tokyo, Japan

[21] Appl. No.: 469,422

[22] Filed: Jun. 6, 1995

Related U.S. Application Data

[63] Continuation of Ser. No. 275,711, Jul. 19, 1994, abandoned.

[30] Foreign Application Priority Data

Jul. 21, 1993 [JP] Japan ..... 5-200969

[51] Int. Cl.[6] ..... G03G 21/00

[52] U.S. Cl. ..... 355/246; 355/207; 355/208; 355/214

[58] Field of Search ..... 355/208, 207, 355/203, 204, 205, 246, 214; 118/688–691, 663–694

[56] References Cited

U.S. PATENT DOCUMENTS 4,982,232 1/1991 Naito ..... 355/208
5,045,883 9/1991 Ishigaki et al. ..... 355/214
5,182,596 1/1993 Nakazawa et al. ..... 355/208 X
5,245,390 9/1993 Ishigaki et al. ..... 355/246
5,253,018 10/1993 Takeuchi et al. ..... 355/246

FOREIGN PATENT DOCUMENTS 0313448 11/1993 Japan .

*Primary Examiner*—Matthew S. Smith
*Attorney, Agent, or Firm*—Fitzpatrick, Cella, Harper & Scinto

[57] ABSTRACT

An image forming apparatus including a rotatable member having an image bearing portion on the surface thereof, image forming device for forming a toner image on the surface of the rotatable member, detecting device for detecting the density of the toner image formed on the surface of the rotatable member under predetermined image forming conditions, and control device for controlling the image forming conditions of the image forming device on the basis of the detection output of the detecting device. The apparatus further includes a memory for storing therein the eccentricity data of the rotatable member, and correcting device for correcting the detection output of the detecting device.

17 Claims, 9 Drawing Sheets

IMAGE FORMING APPARATUS

This application is a continuation of application Ser. No. 08/275,711 filed Jul. 19, 1994, now abandoned.

BACKGROUND OF THE INVENTION

1. Field of the Invention

This invention relates to an image forming apparatus such as a copying machine or a printer of the electrophotographic type or the electrostatic recording type in which a developer is caused to adhere to a latent image formed on an image bearing member to thereby make the latent image into a visible image.

2. Related Background Art

There is known an image forming apparatus in which predetermined image forming conditions, for example, a charging voltage, an exposure amount, developing bias, etc. are set to predetermined values and a patch-like image is formed on a photosensitive medium and the density thereof is read and the quantity of toner supplied is controlled on the basis of the result of this reading so as to keep the density of an output image constant.

As an example of the above-described image forming apparatus, a full color image forming apparatus is schematically shown in FIG. 8 of the accompanying drawings. In this image forming apparatus, a photosensitive drum 1 as an image bearing member is supported for rotation in the direction of arrow R1, and around it, there are disposed a corona charger 2, an optical system 3, a developing device 5, a transfer device 6 and a cleaning device 7.

The optical system 3 is a laser beam exposure device which comprises an original scanning portion and a color resolving filter and applies a color-resolved optical image E or an optical image E corresponding thereto to the photosensitive drum 1. The optical image E for each resolved color is applied to the photosensitive drum 1 uniformly charged by the charger 2 to thereby form an electrostatic latent image. The developing device 5 is a rotatable developing device comprising four developing devices, i.e., a black developing device 5BK, a cyan developing device 5C, a magenta developing device 5M and a yellow developing device 5Y, disposed around a center shaft *5a*, and a predetermined one of the developing devices is rotated to a developing position opposed to the photosensitive drum 1 to thereby develop an electrostatic latent image on the photosensitive drum 1 and form a toner image on the photosensitive drum 1 using a toner having resin as a base substance.

Further, the toner image on the photosensitive drum 1 is transferred to a recording medium conveyed along a paper path indicated by a dotted line, from a recording medium cassette 30 through a conveying system and the transfer device 6, and supplied to a position opposed to the photosensitive drum 1. In the present example, the transfer device 6 has a transfer drum *6a*, a transfer corona charger *6b*, an adsorbing corona charger *6c* for electrostatically adsorbing the recording medium, an adsorbing roller *6d* opposed thereto, an inner corona charger *6e* and an outer corona charger *6f*, and a recording medium carrying sheet *6g* formed of a dielectric material is cylindrically and integrally extended in a peripheral open region of the transfer drum *6a* supported so as to be rotatively driven. As the transfer drum *6a* is rotated in the direction of arrow R2, the toner image on the photosensitive drum 1 is transferred onto the recording medium carried on the recording medium carrying sheet *6g*, by the transfer charger *6b*. Toner images of other colors are successively transferred to the recording medium adsorbed and conveyed on the recording medium carrying sheet *6g* and finally, a desired number of colored images are transferred to the recording medium, whereby a full color image is formed thereon.

When the transfer of a desired number of toner images is terminated in this manner, the recording medium is separated from the transfer drum *6a* by a separating device 9 and is discharged onto a paper discharge tray 31 through a heat roller fixing device 10. On the other hand, any residual toner on the surface of the photosensitive drum 1 after the image transfer may be removed by the cleaning device 7 and the drum again becomes ready for use in a series of image forming processes.

The operation of controlling the density of the developer is performed in parallel with the above-described image forming processes. As shown in FIG. 2 of the accompanying drawings, a patch-like reference electrostatic latent image (hereinafter referred to as the "patch latent image") corresponding to a predetermined density is formed on the photosensitive drum 1 and it is developed by a toner and thereby made into a patch-like reference image (hereinafter referred to as the "patch image") P, and light is applied from an LED *11a* of a density detection sensor (density detecting means) of the optical reflected light quantity detection type to the patch image P, and the reflected light therefrom is received by a photodiode *11b* to thereby detect the density of the patch image P. Since this density corresponds to the toner density of the two-component developer in the developing device 5, the detected density is compared with a reference value to thereby take the difference therebetween, and on the basis of this difference, the amount of fluctuation of the density of the developer is calculated, and it is converted into a toner supply quantity (supply time), and a predetermined quantity of toner is supplied from a toner supply tank into the developing device 5, whereby control is effected so as to keep the density of the output image constant.

In the above-described prior art, however, the patch latent image formed on the image bearing member is developed into the patch image P, and the reflection density of this patch image P is detected by the density detection sensor and on the basis of the result of this detection, the supply of the toner is effected, but as shown in FIG. 3 of the accompanying drawings, there is eccentricity on the photosensitive drum 1 in each phase, and the gap between the photosensitive drum 1 and the developing sleeve of the developing device (hereinafter referred to as the "S-D gap") fluctuates by the rotation of the photosensitive drum and developing efficiency varies. FIG. 4 of the accompanying drawings shows the characteristic of the output of the density detection sensor for the S-D gap. As can be seen from this figure, the S-D gap fluctuates, whereby the density of the image varies and, as a matter of course, the output of the density detection sensor also greatly fluctuates. Therefore, it has been found that even if the patch image P is formed under the same image forming conditions, when the patch image formation position on the photosensitive drum 1 varies, the output of the density detection sensor includes not only the variation in the density of the developer, but also the variation in developing efficiency by the difference in the eccentric amount of the photosensitive drum, i.e., the difference in the S-D gap. Accordingly, if the output value of the sensor is simply fed back to the density control for the developer, then accurate control of the density of the developer can not be accomplished.

SUMMARY OF THE INVENTION

The present invention has been made in view of the above-noted problem and an object thereof is to provide an image forming apparatus in which the image forming conditions of image forming device can be controlled accurately.

Another object of the present invention is to provide an image forming apparatus in which the density of a developer in a developing device can be controlled to a desired value.

Still another object of the present invention is to provide an image forming apparatus in which the irregularity of the density of an output image can be minimized.

Further objects of the present invention will become apparent from the following detailed description when read with reference to the accompanying drawings.

DESCRIPTION OF THE PREFERRED EMBODIMENTS

Some embodiments of the present invention will hereinafter be described with reference to the drawings.

<Embodiment 1>

Figure 1:
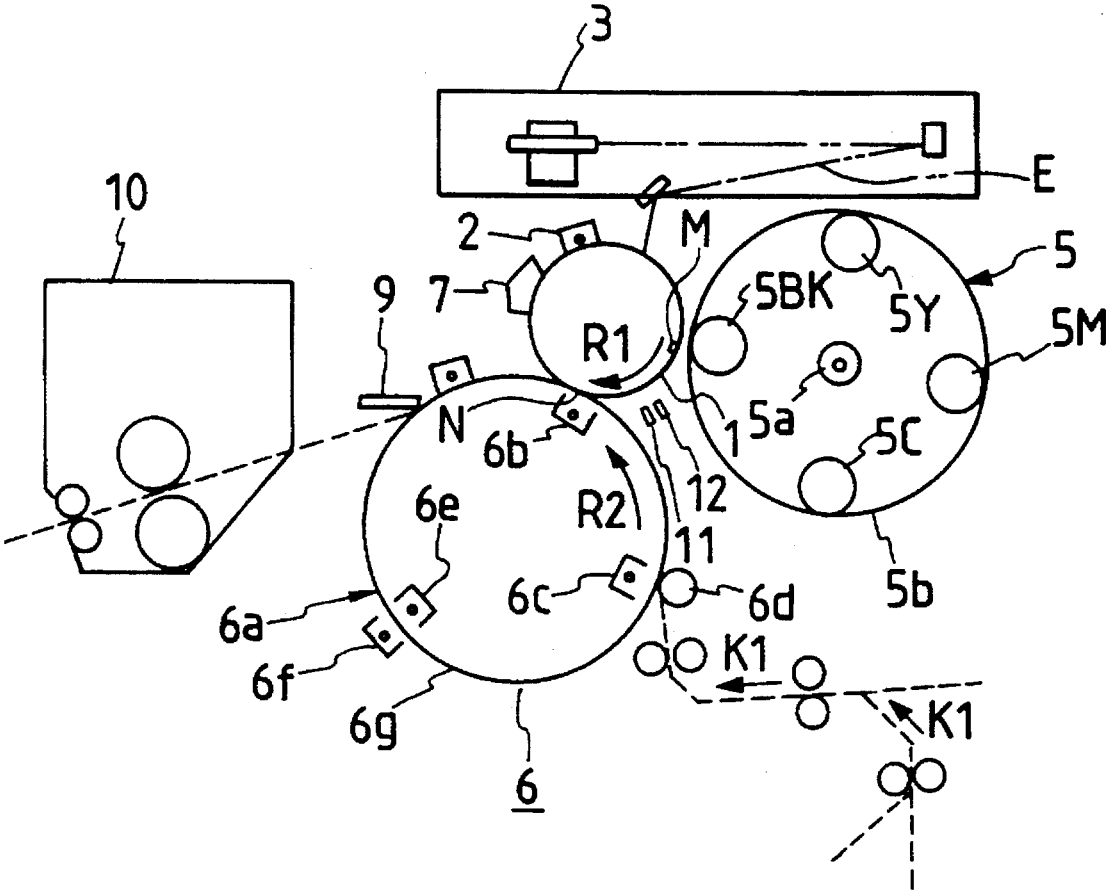
FIG. 1 is a longitudinal cross-sectional view schematically showing an image forming apparatus according to Embodiment 1 of the present invention.

As an embodiment of the image forming apparatus according to the present invention, a color image forming apparatus for forming a full color image is schematically shown in FIG. 1. In this apparatus, members functionally similar to those in the afore-described apparatus are given the same reference characters.

In the image forming apparatus of the present embodiment, a photosensitive drum 1 which is an image bearing member, is supported for rotation in the direction of arrow R1. Around this photosensitive drum 1 and along the direction of rotation thereof, there are successively disposed image forming means such as a corona discharger 2, an optical system 3 and a developing device 5, a transfer device 6 and a cleaning device 7.

The optical system 3 is, for example, a laser beam exposure device which comprises an original scanning portion and a color resolving filter and applies a color-resolved optical image E or an optical image E corresponding thereto to the photosensitive drum 1. The optical image E for each resolved color is applied to the photosensitive drum 1 uniformly charged by the charger 2 to thereby form an electrostatic latent image on the photosensitive drum 1. The developing device 5 is a rotatable developing device provided with a rotatable member **5*b* rotatable about a center shaft 5*a*, and four developing devices carried thereon, i.e., a black developing device 5BK, a cyan developing device 5C, a magenta developing device 5M and a yellow developing device 5Y, and a predetermined one of the developing devices is rotated to a developing position opposed to the photosensitive drum 1 and a toner having resin as a basic substance is caused to adhere to the electrostatic latent image on the photosensitive drum 1 to thereby develop the latent image, thus forming a toner image on the photosensitive drum 1**.

Further, the toner image on the photosensitive drum 1 is transferred to a recording medium supplied from a recording medium cassette (not shown) to a transfer position N opposed to the photosensitive drum 1 (in the direction of arrow K1 along a paper path indicated by a dotted line) through a conveying system and the transfer device 6. The transfer device 6, in the present embodiment, has a transfer drum **6*a*, a transfer corona charger 6*b*, an adsorbing corona charger 6*c* for electrostatically adsorbing the recording medium, an adsorbing roller 6*d* opposed thereto, an inner corona charger 6*e* and an outer corona charger 6*f*, and a recording medium carrying sheet 6*g* formed of a dielectric material is cylindrically and integrally extended in the peripheral open region of the transfer drum 6*a* supported so as to be rotatively driven. As the transfer drum 6*a* is rotated, the toner image on the photosensitive drum 1 is transferred onto the recording medium carried on the recording medium carrying sheet 6*g*, by the transfer charger 6*b*. A desired number of colored images are transferred onto the recording medium adsorbed and conveyed on the recording medium carrying sheet 6*g***, whereby a full color image is formed on the recording medium.

When the transfer of a desired number of toner images is terminated in this manner, the recording medium is separated from the transfer drum **6*a* by a separating device 9, and an output image is obtained through a heat roller fixing device 10. On the other hand, any residual toner on the surface of the photosensitive drum 1 after the image transfer is removed by the cleaning device 7** and the drum again becomes ready for use in the image forming processes.

Figure 2:
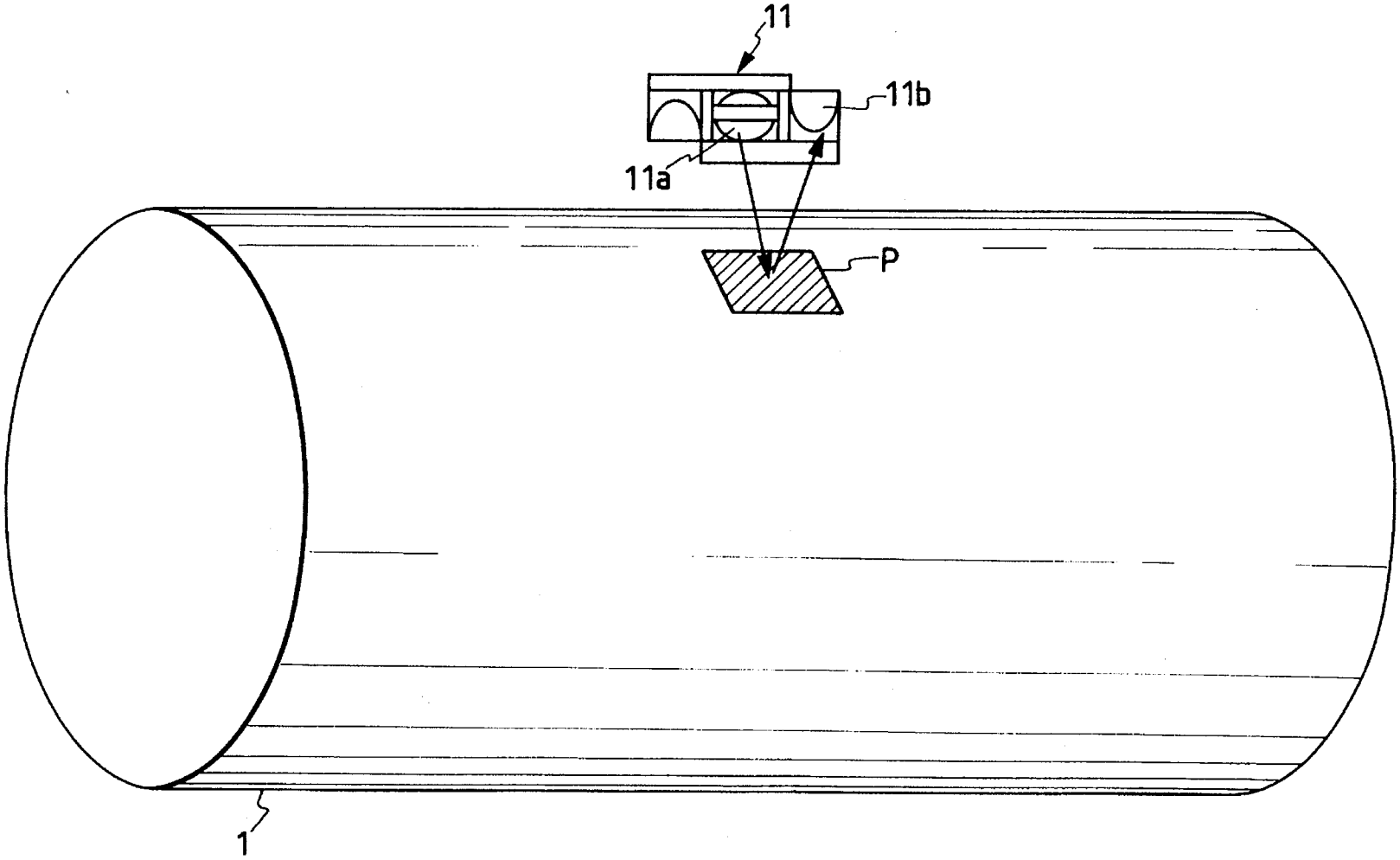
FIG. 2 is a perspective view showing the construction of a density detection sensor.

The control of the density of the developer is effected in parallel with the above-described series of image forming processes. That is, it is effected each time an image is formed or each time a predetermined number of images are formed. As shown in FIG. 2, a patch-like patch latent image (reference electrostatic latent image) corresponding to predetermined density is formed in front of the image forming area on the photosensitive drum 1 and is developed with the toner to thereby form a patch-like patch image (reference image) P. Light is applied from the LED **11*a* of the density detection sensor (density detecting means) 11 of the optical reflected light quantity detection type to the patch image P, and the reflected light thereof is received by a photodiode 11*b* to thereby detect the density of the patch image P. The output of the density detection sensor 11 is then corrected on the basis of the eccentric amount of the photosensitive drum relative to the patch image, and the corrected value is compared with a reference value to thereby take the difference therebetween, and the amount of fluctuation of the density of the developer is calculated from this difference, and it is converted into a quantity of toner supply (supply time) and a predetermined quantity of toner is supplied from a toner supply tank into the developing device 5**, whereby control is effected so as to keep the density of the output image constant.

Figure 3:
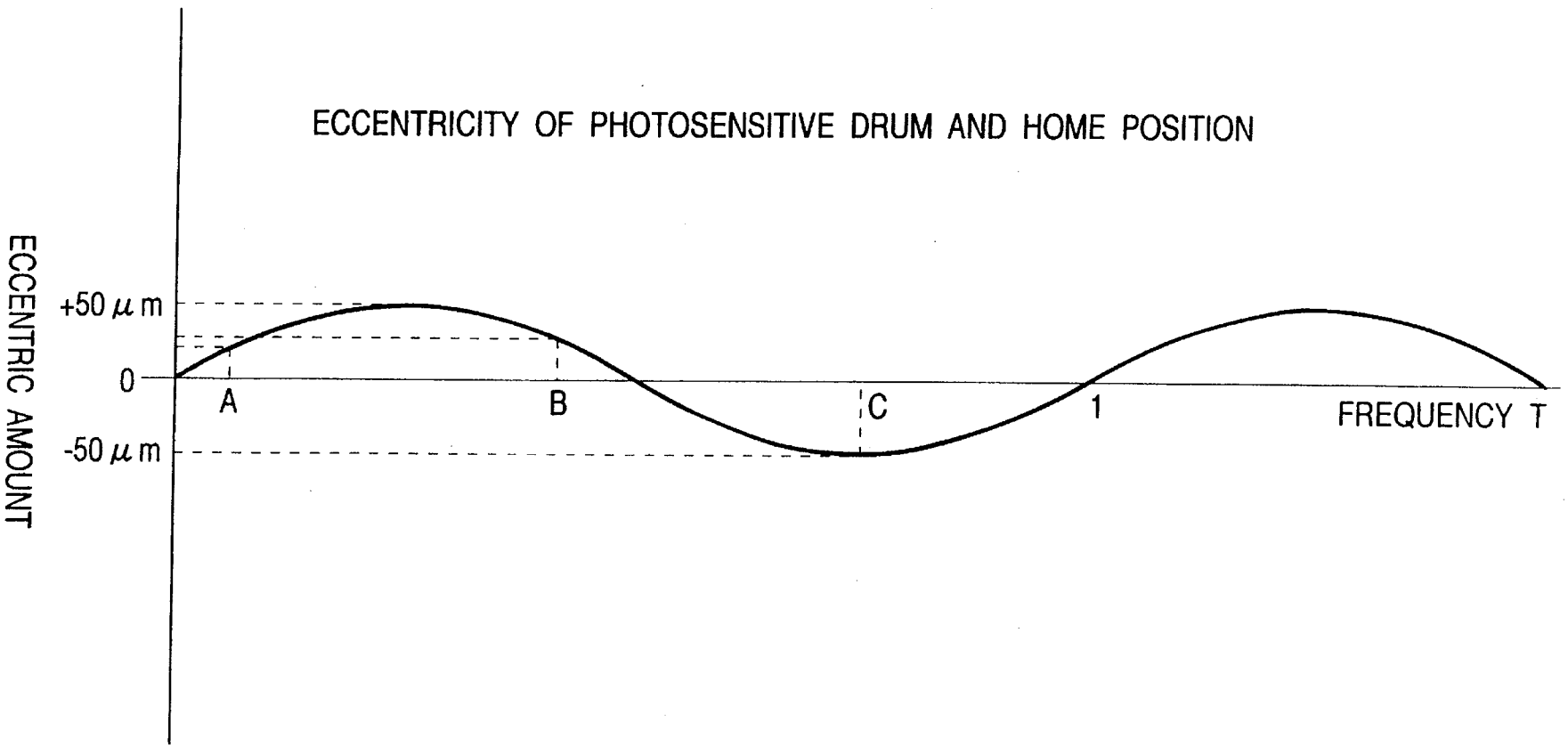
FIG. 3 shows the eccentric state of a photosensitive drum.
Figure 4:
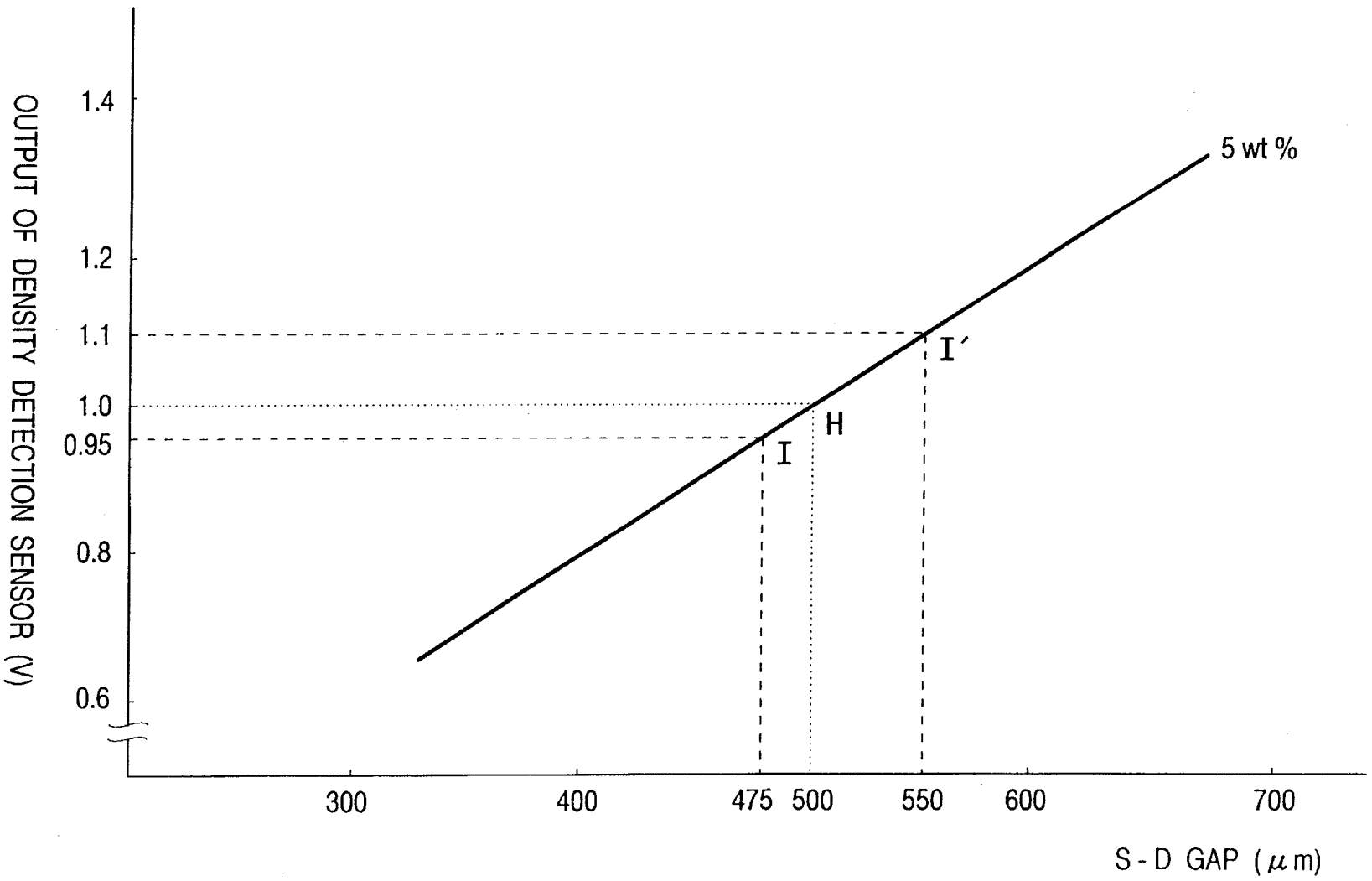
FIG. 4 is a graph showing the relation between the S-D gap and the output of the density detection sensor.

FIG. 3 is a graph illustrating the amount of eccentricity at the developing position of a photosensitive drum (the position at which a developing sleeve in the developing device is opposed to the photosensitive drum), the amount of eccentric of the photosensitive drum 1 being measured for each phase. As shown in FIG. 3, the photosensitive drum delicately differs in the distance between the rotary shaft and peripheral surface thereof, i.e., the radius thereof, depending on the circumferential position thereof. By this eccentricity, the S-D gap (the distance between the surface of the photosensitive drum and the surface of the developing sleeve) fluctuates and the output of the density detection sensor varies as shown in FIG. 4. So, in the present embodiment, a memory device (not shown) pre-stores therein the eccentric amount of the photosensitive drum 1 for each phase with the home position M set on the photosensitive drum 1 as the reference.

The control of the density of the developer in the present embodiment will now be specifically described.

As shown in FIG. 1, a home position sensor (home position detecting means) 12 is provided near the density detection sensor 11 in opposed relationship with the photosensitive drum 1. A fluctuated value of the output of the density detection sensor due to fluctuation of the S-D gap of the position at which the patch image P is formed can be calculated on the basis of the home position M, the eccentricity data of the photosensitive drum 1 and the phase from the home position M to the patch image P. So, description will first be made of a method of correcting the output value of the density detection sensor due to a variation in the S-D gap when the density of the developer in the developing device is free of any variation and is constant at a reference value.

It is to be understood that the density of the developer is constant at 5% by weight. It is also to be understood that the S-D gap at the position whereat the eccentric amount of the photosensitive drum is 0 (zero) is 500 μm. If under such conditions, the home position M of the photosensitive drum 1 is at a position A in FIG. 3 and the patch image P is formed at a position B, then the output I of the density detection sensor will be detected as a value (0.95 V) lower than a proper value by 50 mV, from FIG. 4, by the eccentric amount at the position B (+25 μm, and at this time, the S-D gap is 495 μm). However, the + (plus) direction of the eccentric amount is a direction in which the S-D gap shortens. Also, the density detection sensor used herein detects the density of the patch image by the quantity of reflected light from the patch image and therefore, the higher the density of the patch image becomes, the smaller the detection output becomes, and the lower the density becomes, the greater the detection output becomes.

Accordingly, if the difference 50 mV from the reference output value H=1.0 V of the density detection sensor when the density of the developer in the developing device is constant, i.e., a predetermined value 5% by weight, and the patch image is formed at the position whereat the eccentric amount of the photosensitive drum is zero is added to the output value I, then the correction of a variation in the developing efficiency caused by the eccentricity of the photosensitive drum at the position B could be effected. If likewise, the patch image P is formed at a position C in FIG. 3, the S-D gap will become 550 μm, wider by 50 μm, and the density of the patch image will become lower than when the patch image is formed at a position whereat the S-D gap is 500 μm and, therefore, the output value I' of the sensor will be detected as being higher by about 100 mV (I'=1.1 V).

Consequently, by subtracting 100 mV from the detection output I' and taking the difference from the reference value H, an accurate signal can be obtained. That is, the home position sensor 12 is mechanically or electrically provided on the photosensitive drum 1, the eccentricity data of the photosensitive drum 1 is memorized, the phase from the home position M to the patch forming position is measured, and from the phase difference, the fluctuated value of the S-D gap can be determined. Therefore, if the output value of the sensor is corrected by this amount of fluctuation of the S-D gap, then there could be always obtained the output value of the sensor when the eccentric amount of the photosensitive drum is zero.

While in the present embodiment the output value of the sensor when the patch image is formed at the position whereat the eccentric amount is zero is used as the reference value, this is not restrictive, but the output value of the sensor at any position other than the position at which the eccentric amount is zero may be used as the reference value. However, since the output value of the sensor at the position whereat the eccentric amount is zero is generally approximate to the average value of the sensor output for one round of the photosensitive drum, it is preferable that the output value of the sensor at the position whereat the eccentric amount is zero be used as the reference value.

Figure 9:
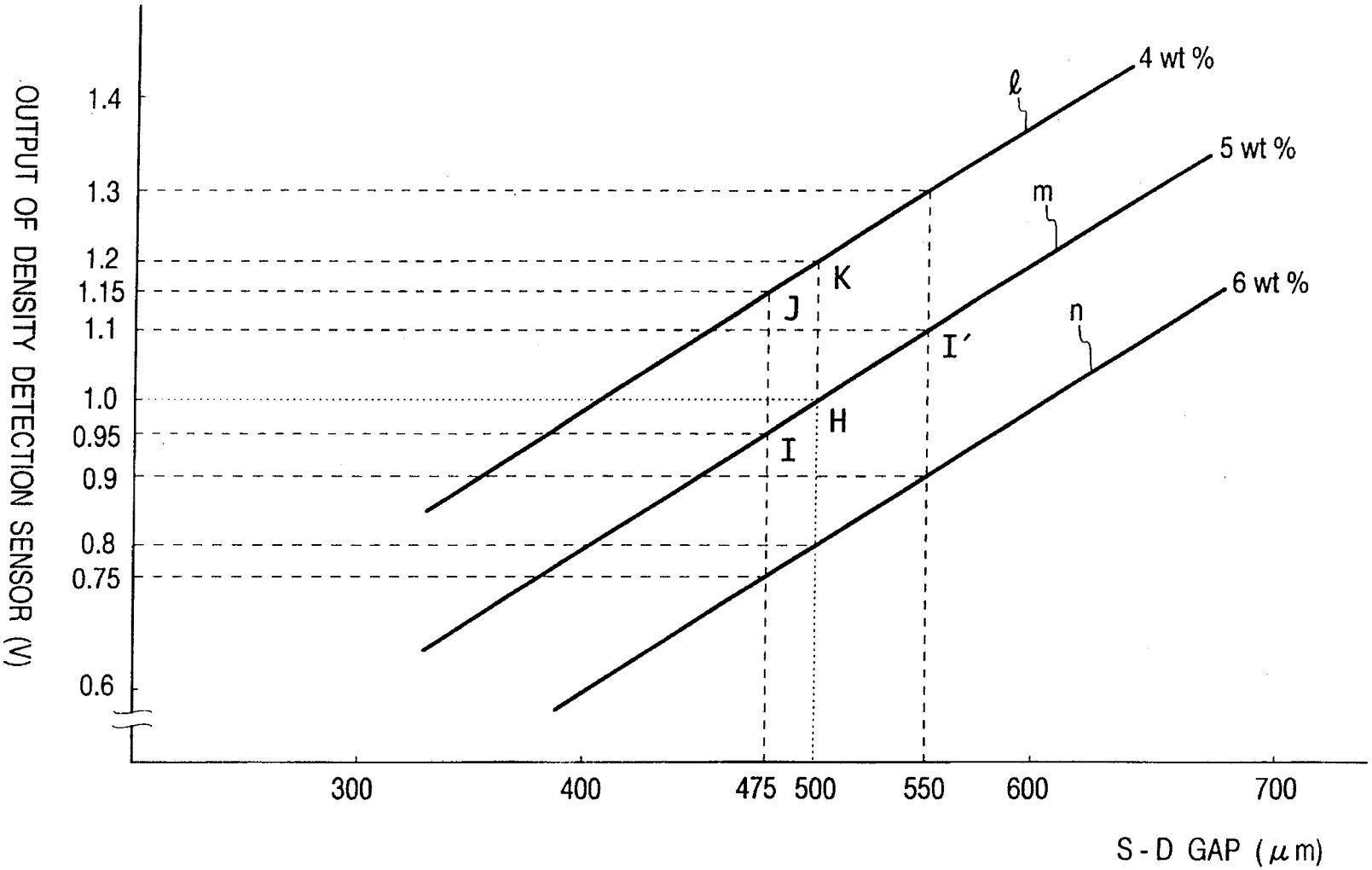
FIG. 9 is a graph showing the relation between the S-D gap and the output of a density detection sensor.

Also, actually, the variation in the density of the developer in the developing device is added to the output value of the sensor. This state is shown in FIG. 9. In the apparatus of the present embodiment, if the density of the developer varies by 1% by weight, then the output value of the sensor will vary by 200 mV. In FIG. 9, a solid line l represents the relation between the S-D gap and the sensor output when the density of the developer is 4% by weight, and a solid line n represents the relation between the S-D gap and the sensor output when the density of the developer is 6% by weight. As a matter of course, the variations are not limited to these patterns, but are infinite.

So, as previously described, if the output value of the sensor is corrected on the basis of the value of the S-D gap (or the eccentric amount) i.e., the eccentricity data, whereafter on the basis of this corrected output value, the amount of supply of the toner is controlled so that the density of the developer may assume a predetermined value (here, 5% by weight), then proper density control could always be effected even when the patch image is formed anywhere on the surface of the photosensitive drum.

When for example, in FIG. 9, the density of the developer is thinner by 1% by weight than a desired value 5% by weight and the patch image is formed on the surface of a photosensitive drum in which the S-D gap is 475 μm, the output value of the density detection sensor becomes J=1.15 V. So, the corrected value 0.05 V of the eccentric amount of the photosensitive drum is added to J=1.15 V to thereby obtain a corrected output value K=1.2 V. Toner corresponding in quantity to the difference between the reference value H=1.0 V when the density is 5% by weight and K=1.2 V can then be supplied.

In the present embodiment, a black toner containing carbon is used, but a similar effect can be obtained irrespective of a carbon constituent and the color of the toner.

<Embodiment 2>

Figure 5:
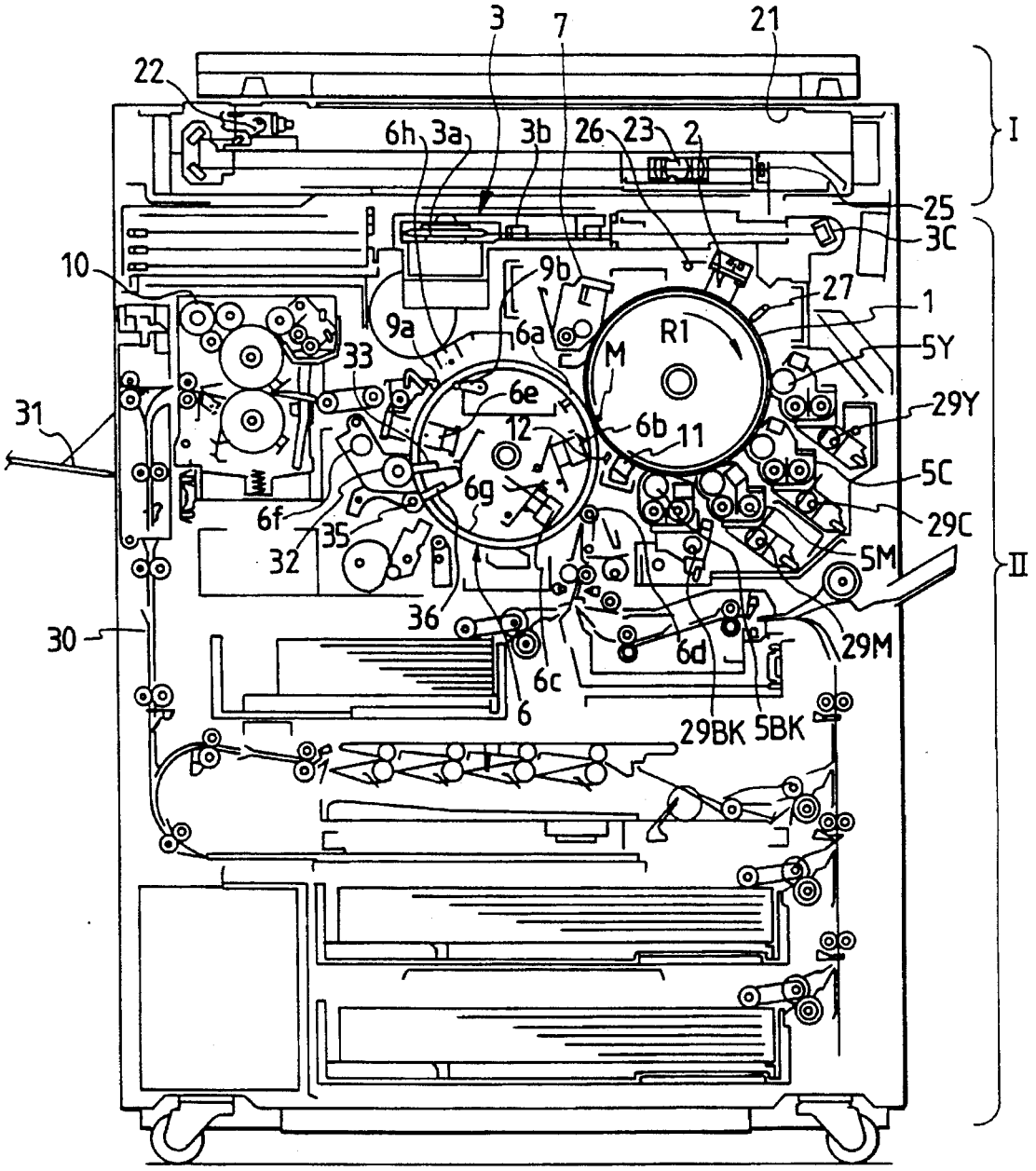
FIG. 5 is a longitudinal cross-sectional view schematically showing an image forming apparatus according to Embodiment 2 of the present invention.

FIG. 5 shows the general construction of a full color copying apparatus. This copying apparatus has a digital color image reader unit I in the upper portion thereof and a digital color image printer unit II in the lower portion thereof.

In the reader unit I, an original is placed on an original supporting glass table 21 and is exposure-scanned by an exposure lamp 22, whereby the reflected optical image from the original is condensed on a full color sensor 25 by a lens 23 to thereby obtain a color-resolved image signal. The color-resolved image signal is processed by a video processing unit (not shown) via an amplifying circuit (not shown) and is delivered to the printer unit.

In the printer unit II, a photosensitive drum 1 which is an image bearing member is supported for rotation in the direction of arrow R1, and around the photosensitive drum 1, there are disposed a pre-exposure lamp 26, a corona charger 2, a laser exposure optical system 3, a potential sensor 27, four developing devices 5Y, 5C, 5M and 5BK differing in color, means for detecting the quantity of light on the drum (density detection sensor) 11, a transfer device 6 and a cleaning device 7. In the laser exposure optical system 3, the image signal from the reader unit I is converted into an optical signal by a laser output portion (not shown), and the converted laser beam is reflected by a polygon mirror 3*a* and is projected onto the surface of the photosensitive drum 1 via a lens 3*b* and a mirror 3*c*.

During image formation by the printer unit II, the photosensitive drum 1 is rotated in the direction of arrow R1, and the photosensitive drum 1 after being de-electrified by the pre-exposure lamp 26 is uniformly charged by the charger 2, and an optical image E is applied to the photosensitive drum for each resolved color to thereby form an electrostatic latent image thereon.

Subsequently, a predetermined one of the developing devices is operated to develop the electrostatic latent image on the photosensitive drum 1, thus forming a toner image having resin as a base substance on the photosensitive drum 1. The respective developing devices are designed to approach the photosensitive drum 1 alternatively in conformity with the respective resolved colors by eccentric cams 29Y, 29C, 29M and 29BK.

Further, the toner image on the photosensitive drum 1 is transferred to a recording medium supplied from a recording medium cassette 30 to a position opposed to the photosensitive drum 1 through a conveying system and the transfer device 6. In the present embodiment, the transfer device 6 has a transfer drum 6*a*, a transfer charger 6*b*, an adsorbing charger 6*c* for electrostatically adsorbing the recording medium, an adsorbing roller 6*d* opposed thereto, an inner charger 6*e* and an outer charger 6*f*, and a recording medium carrying sheet 6*g* formed of a dielectric material is cylindrically and integrally extended in the peripheral open region of the transfer drum 6*a* supported so as to be rotatively driven. The recording medium carrying sheet 6*g* used is a sheet of a dielectric material such as polycarbonate film.

As the drum-shaped transfer device, i.e., the transfer drum 6*a*, is rotated, the toner image on the photosensitive drum 1 is transferred onto the recording medium carried on the recording medium carrying sheet 6*g*, by the transfer charger 6*b*.

In this manner, a desired number of colored images are transferred onto the recording medium adsorbed and conveyed on the recording medium carrying sheet 6*g* to thereby form a full color image. In the case of full color image formation, when the transfer of the toner images of four colors is terminated, the recording medium is separated from the transfer drum 6*a* by the actions of a separating pawl 9*a*, a separating and pushing-up roller 9*b* and a separating charger 6*h*, and is discharged onto a paper discharge tray 31 through a heat roller fixating device 10.

On the other hand, the photosensitive drum 1 after image transfer has any residual toner on its surface removed by the cleaning device 7 and becomes ready for use in another cycle of the image forming process. Also, in order to prevent the scattering and adherence of powder on the recording medium carrying sheet 6*g* of the transfer drum 6*a* and the adherence or the like of oil on the recording medium, cleaning is effected by the actions of a fur brush 32 and a backup brush 33 opposed to the fur brush 32 with the recording medium carrying sheet 6*g* interposed therebetween, and an oil removing roller 35 and a backup brush 36 opposed to the roller 35 with the recording medium carrying sheet 6*g* interposed therebetween. Such cleaning is effected before or after image formation, and when paperjam has occurred. Such cleaning may be effected at any time.

Figure 6:
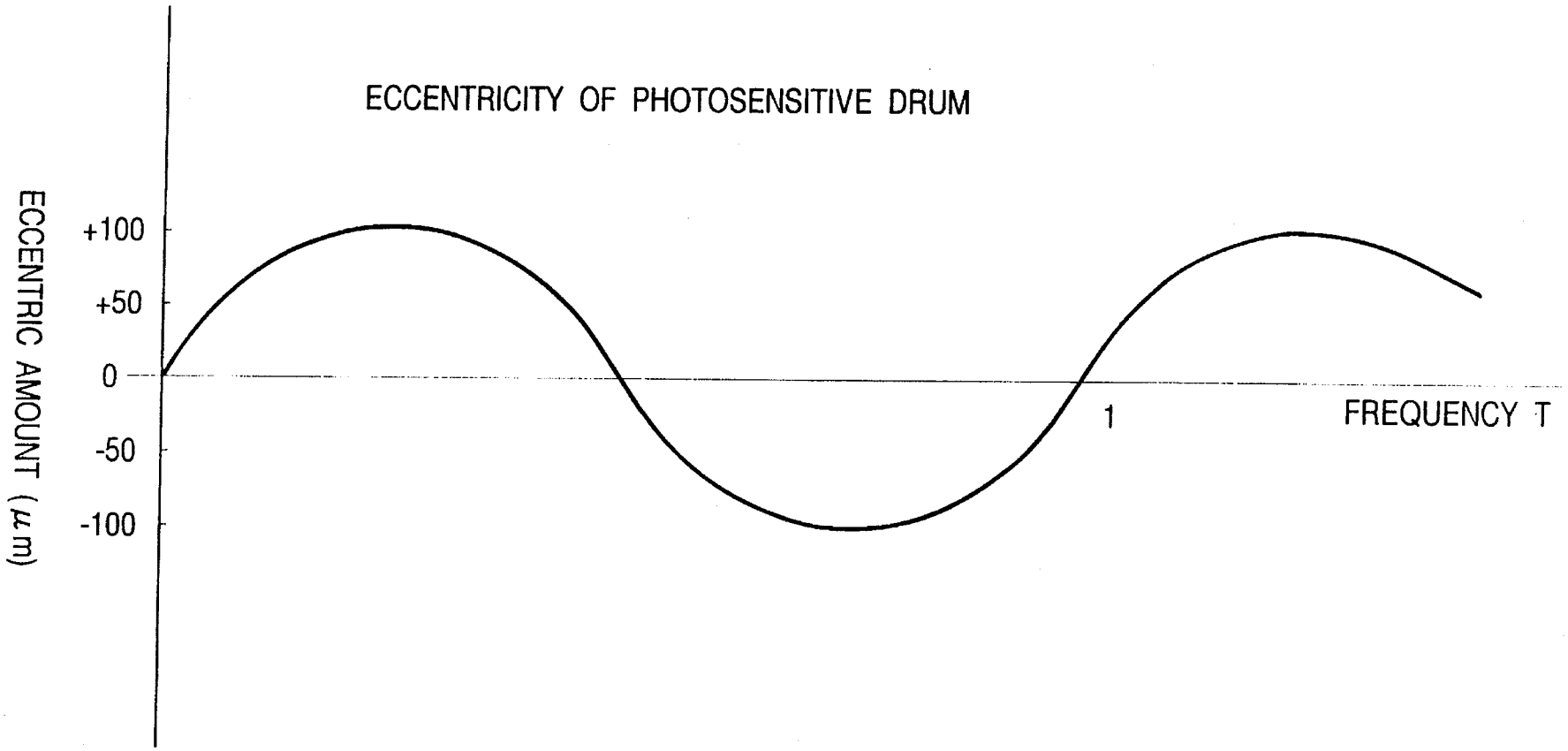
FIG. 6 shows the eccentric state of a photosensitive drum having a large diameter (180 mm) in Embodiment 2.

The operation of controlling the density of the developer is performed in parallel with the above-described image forming processes. The eccentric amount of the photosensitive drum 1 for each phase is measured in advance and its relation with the home position M is memorized. Subsequently, a patch image P is formed and the density is detected by the density detection sensor 11. The density detection output is then corrected on the basis of the eccentric amount by the phase difference between the patch image forming position and the home position M, and the corrected density detection output is compared with a reference value to thereby calculate the amount of fluctuation of the density of the developer, and it is converted into a quantity of toner supply and the supply of the developer is effected, whereby the density of the developer and the density of the output image can be stabilized. FIG. 6 shows the eccentric amount measured when the diameter of the photosensitive drum 1 is 180 mm, and the larger the diameter becomes, the more the eccentric amount increases. When the diameter exceeds 140 mm, the irregularity of the image density due to eccentricity is liable to be conspicuous. The present invention is particularly effective when an attempt is made to obtain a high quality image when the photosensitive drum 1 has a large diameter like this.

<Embodiment 3>

Figure 7:
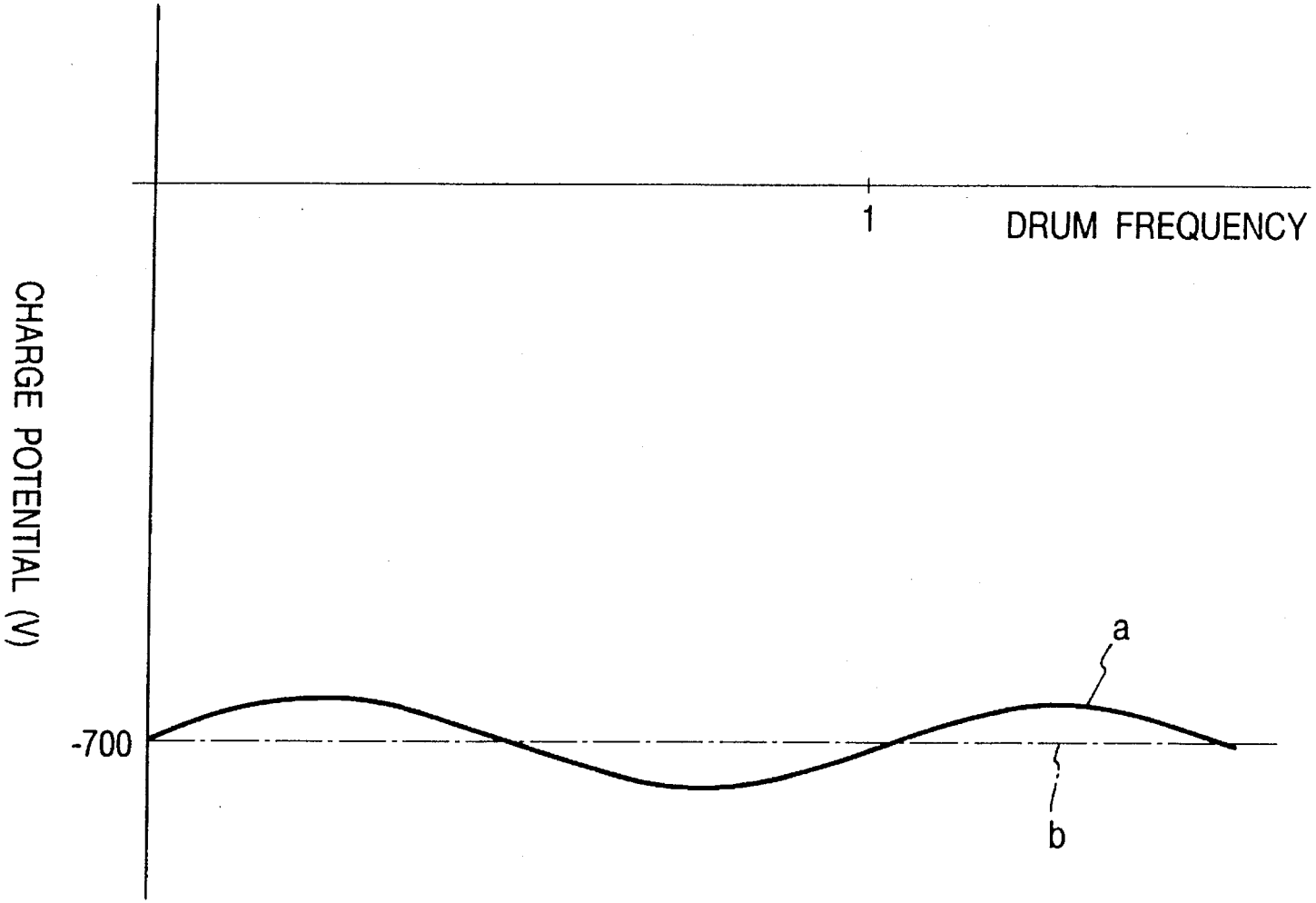
FIG. 7 shows the charging irregularity caused by the eccentricity of the photosensitive drum.
Figure 8:
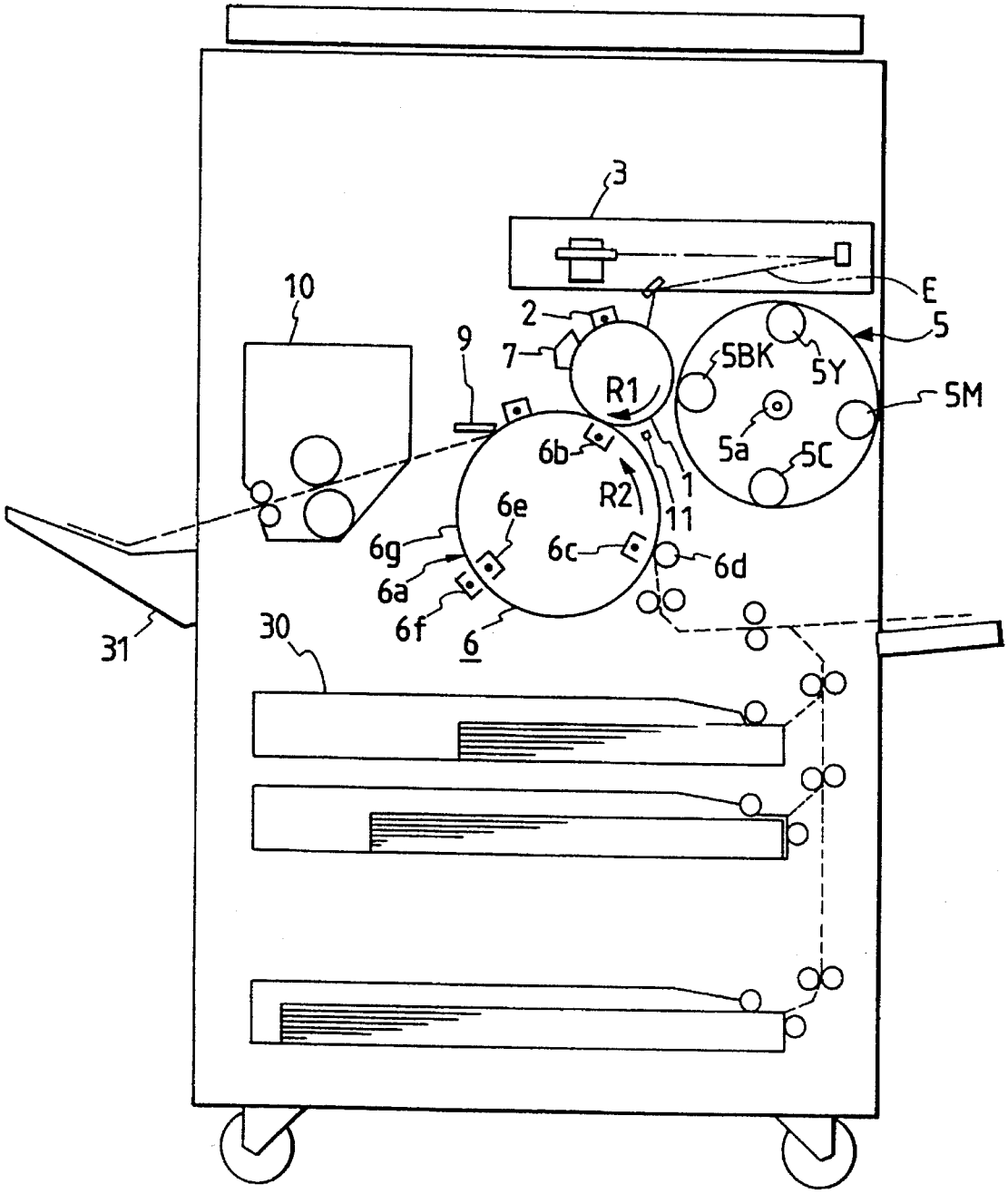
FIG. 8 (PRIOR ART)
FIG. 8 is a longitudinal cross-sectional view schematically showing an image forming apparatus according to the prior art.

In an image forming apparatus using a photosensitive drum 1 of a large diameter like that of Embodiment 2, the charge potential of the photosensitive drum 1 due to the charger 2 is fluctuated particularly by the eccentricity of the photosensitive drum 1 depending on the frequency of the eccentricity, as indicated by a solid line in FIG. 7. The eccentricity of the photosensitive drum 1 is detected with the home position M given to the photosensitive drum i and the charging voltage of the charger 2 is corrected, whereby as indicated by b (dot-and-dash line) in FIG. 7, any irregularity due to the charging can be decreased and a uniform output image can be obtained.

As described above, the apparatus of the present invention has a memory for storing therein the eccentricity data of a rotatable member having an image bearing portion on the surface thereof, and correcting means for correcting the output from the density detecting means on the basis of said eccentricity data, and the image forming conditions of the image forming means are controlled on the basis of said corrected output value and therefore, even if a patch image is formed at any position on the surface of the rotatable member, an accurate adjustment of the image forming conditions including the density of the developer can be effected.

The present invention is not restricted to the above-described embodiments, but covers any and all modifications within the same technical idea.

What is claimed is:

1. An image forming apparatus comprising:

a rotatable member having an image bearing portion on the surface thereof;

image forming means for forming a toner image on the surface of said rotatable member;

detecting means for detecting a density of a predetermined toner image formed on the surface of said rotatable member under a predetermined image forming condition; and control means for controlling an image forming condition of said image forming means when forming a toner image corresponding to image information on the basis of the density detected by said detecting means and eccentricity data of said rotatable member.

2. An image forming apparatus according to claim 1, wherein said rotatable member has a drum-like shape.

3. An image forming apparatus according to claim 1, wherein the eccentricity data of said rotatable member represents the amount of eccentricity of said rotatable member in each phase in the circumferential direction thereof.

4. An image forming apparatus according to claim 1, wherein said image forming means includes developing means for supplying toner to said rotatable member, and said control means controls said developing means to form a toner image having a density determined on the basis of the density of the predetermined toner image detected by said detecting means.

5. An image forming apparatus according to claim 1, further comprising a memory for storing therein eccentricity data of said rotatable member, and correcting means for correcting the density detected by said detecting means on the basis of the eccentricity data.

6. An image forming apparatus according to claim 1, wherein said image forming means includes charging means for charging the image bearing portion of said rotatable member, and said control means controls a bias voltage applied to said image bearing portion by said charging means.

7. An image forming apparatus according to claim 1, wherein said rotatable member includes a photosensitive layer.

8. An image forming apparatus, comprising:

a rotatable member having an image bearing portion on a surface thereof;

image forming means for forming a toner image on the surface of said rotatable member;

detecting means for detecting a density of a predetermined toner image formed on the surface of said rotatable member under a predetermined image forming condition; and control means for controlling an image forming condition of said image forming means when forming a toner image corresponding to image information on the basis of the density detected by said detecting means and an image forming position of the predetermined toner image in a circumferential direction of said rotatable member.

9. An image forming apparatus according to claim 8, further comprising a memory for storing therein eccentricity data of said rotatable member, and correcting means for correcting the density detected by said detecting means on the basis of the eccentricity data.

10. An image forming apparatus according to claim 8, wherein said image forming means includes developing means for supplying toner to said rotatable member, and said control means controls said developing means to form a toner image on the basis of the density of the predetermined toner image detected by said detecting means.

11. An image forming apparatus according to claim 8, wherein said image forming means includes charging means for charging the image bearing portion of said rotatable member, and said control means controls a bias voltage applied to said image bearing portion by said charging means.

12. An image forming apparatus according to claim 8, wherein said rotatable member includes a photosensitive layer.

13. An image forming apparatus, comprising:

a rotatable member having an image bearing portion on a surface thereof;

image forming means for forming a toner image on the surface of said rotatable member, and having a toner bearing body opposed to said rotatable member;

detecting means for detecting a density of a predetermined toner image formed on the surface of said rotatable member under a predetermined image forming condition; and control means for controlling an image forming condition of said image forming means when forming a toner image corresponding to image information on the basis of the density of the predetermined toner image detected by said detecting means and a distance between said rotatable member and said toner bearing body.

14. An image forming apparatus according to claim 13, further comprising a memory for storing therein eccentricity data of said rotatable member, and correcting means for correcting the density of the predetermined toner image detected by said detecting means on the basis of the eccentricity data.

15. An image forming apparatus according to claim 13, wherein said image forming means includes developing means for supplying toner to said rotatable member, and said control means controls said developing means to form a toner image on the basis of the density of the predetermined toner image detected by said detecting means.

16. An image forming apparatus according to claim 13, wherein said image forming means includes charging means for charging the image bearing portion of said rotatable member, and said control means controls a bias voltage applied to said image bearing portion by said charging means.

17. An image forming apparatus according to claim 13, wherein said rotatable member includes a photosensitive layer.

* * * * *